US012396507B1

(12) United States Patent
Davis

(10) Patent No.: US 12,396,507 B1
(45) Date of Patent: Aug. 26, 2025

(54) REINFORCED SEPARABLE WAISTBAND FOR UNIFORM GARMENTS

(71) Applicant: JaLidia Denise Davis, Montgomery, AL (US)

(72) Inventor: JaLidia Denise Davis, Montgomery, AL (US)

( * ) Notice: Subject to any disclaimer, the term of this patent is extended or adjusted under 35 U.S.C. 154(b) by 0 days.

(21) Appl. No.: 18/786,889

(22) Filed: Jul. 29, 2024

(51) Int. Cl.
*A41F 9/00* (2006.01)
*A41F 17/00* (2006.01)
*A41F 17/02* (2006.01)

(52) U.S. Cl.
CPC ..... *A41F 9/007* (2013.01); *A41F 9/002* (2013.01); *A41F 17/00* (2013.01); *A41F 17/02* (2013.01)

(58) Field of Classification Search
CPC ..... A41F 9/007; A41F 9/002; A41F 17/00; A41F 17/02
See application file for complete search history.

(56) References Cited

U.S. PATENT DOCUMENTS 709,823 A * 9/1902 Mehlfeld ..... A41F 9/002 2/312
1,037,518 A * 9/1912 Paull ..... A41F 17/00 2/273
1,558,228 A * 10/1925 Botkin ..... A41F 9/002 2/300
1,958,643 A * 5/1934 Silverman ..... A41F 17/00 24/337
3,872,518 A * 3/1975 Zaoui ..... A41F 9/007 2/271
9,015,867 B2 * 4/2015 Kenney ..... A41D 13/0017 2/229
10,051,948 B2 * 8/2018 Carver ..... A45F 5/021
11,147,328 B2 * 10/2021 Fayle ..... B65D 33/28
12,070,091 B2 * 8/2024 Rodgers ..... A41F 17/04
2004/0083525 A1 * 5/2004 Wells, Jr. ..... F41H 1/02 2/2.5
2005/0246820 A1 * 11/2005 Davenport ..... A41F 9/02 2/227
2009/0070915 A1 * 3/2009 Hill ..... A41B 1/00 2/311
2014/0317832 A1 * 10/2014 Allen ..... A41D 1/06 2/236
2020/0390163 A1 * 12/2020 Eder ..... A41D 15/00

* cited by examiner

*Primary Examiner* — Khaled Annis

(57) ABSTRACT

A uniform garment having a top and bottom. The bottom garment has an upper portion including a waistband, and a lower portion forming a skirt or pair of trousers. Between the upper and lower portions, a device for selectively separating the upper portion from the lower portion. The upper portion includes a supporting structure for attaching a utility or tactical belt thereto. In this manner, the utility/tactical belt is kept in place, and readily accessible, while the lower portion is selectively separated from the upper portion. The supporting structure includes a channel, anchors slidably disposed therewithin, and brackets for attaching to the anchors. The brackets support the utility/tactical belt, keeping the components thereof readily accessible. The channel may be formed on a belt that is threaded through the belt loops of the waistband portion.

9 Claims, 8 Drawing Sheets

REINFORCED SEPARABLE WAISTBAND FOR UNIFORM GARMENTS

This application claims the benefit under 35 U.S.C. § 119(e) of U.S. Provisional Patent Application No. 63/529,347 filed on Jul. 27, 2023, and entitled "REINFORCED SEPARABLE WAISTBAND FOR UNIFORM GARMENTS," the entire contents of which are hereby incorporated by reference herein and made part of this specification for all that they disclose.

BACKGROUND

A uniform typically consists of a shirt or blouse, and a pair of trousers or a skirt. In special instances, the trousers or skirt, has a normal support belt, that is fed through belt loops spaced around the top of the trousers or skirt. In many instances, the support belt also supports an attachment belt, typically carrying a multiplicity of job-related accessories, namely referred to as an accessory belt, a utility belt, and/or tactical belt. With respect to law enforcement and military applications the attachment belt would be a tactical belt carrying, inter alia, a weapon holster.

It is well known for the professional that it is a regular ordeal to become fully dressed, including the tactical belt, in uniform and be able to function within the job details. However, one aspect of the job details, particularly with professions that require the carrying of a weapon, namely a sidearm, that the sidearm be always ready and accessible on the tactical belt. The drawback is if the professional has to take a moment to use the restroom, often the tactical belt must be removed and placed in a position that is not preferable to the job.

BRIEF SUMMARY OF THE INVENTION

The present disclosure provides a relief for the uniformed professionals that allow the ability to take a restroom break without relinquishing or severely reducing the accessibility of their weapon. The present disclosure offers an improved garment, typically the trousers or skirt, hereafter the uniform bottom, to be separable. The uniform bottom will have an upper portion and a lower portion. The lower portion consists of a skirt, skort, shorts, trousers, pants, or the like. The upper portion primarily consists of a waistband. The waistband has a plurality of belt loops for threading a standard belt therethrough. The standard belt provides support of the uniform bottom about the waist/hips of the professional. The standard belt has also provided some support of the tactical belt; thus the professional would have to remove the tactical belt to access the standard belt to remove the bottom garment. By the instant disclosure, the waistband with the standard belt and the tactical belt are maintained in position about the professional, so as to allow the professional to have ready access at all times to their weapon. Moreover, the waistband of the uniform garment is further enhanced so as to support the tactical belt without interfering with the separating and attaching of the lower portion of the bottom garment.

DETAILED DESCRIPTION AND BEST MODE OF IMPLEMENTATION

Figure 2:
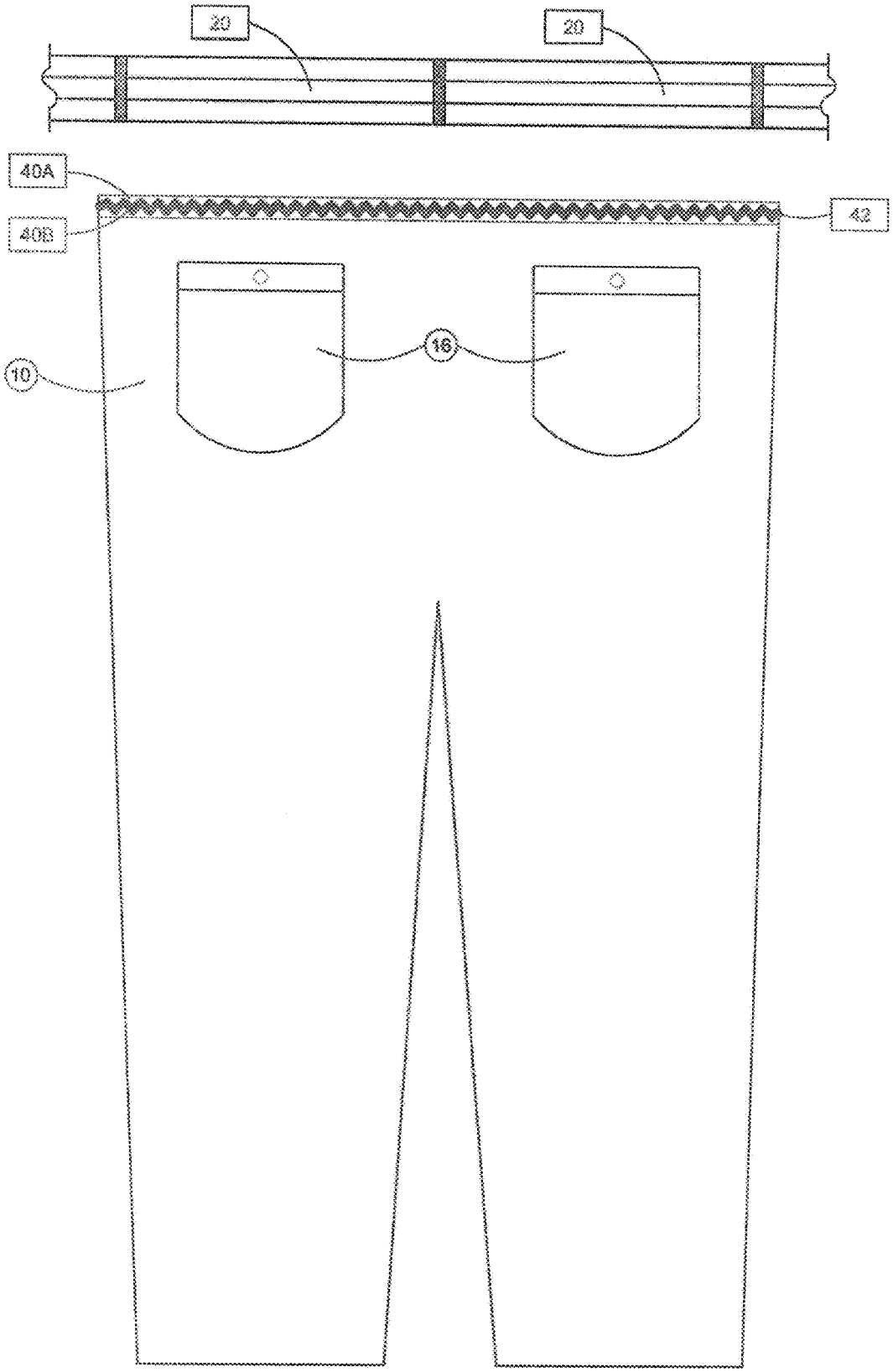
FIG. 2 shows a rear elevational view of the preferred aspect of the invention.
Figure 3:
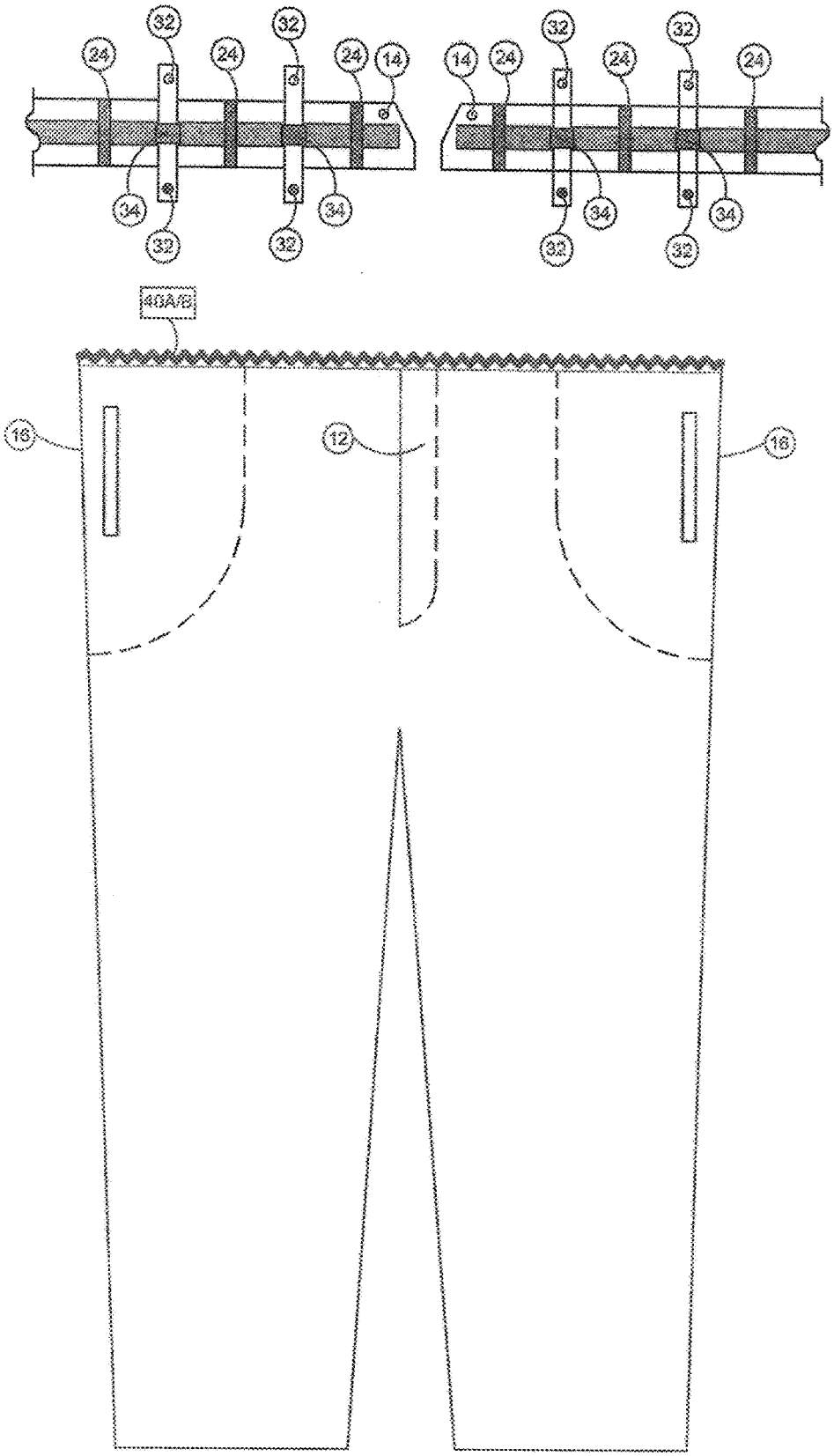
FIG. 3 shows an elevational view of another preferred aspect of the invention.

In FIG. 2, a uniform garment 100 having two sections, an upper section 20 and a lower section 10. The upper section 20 contains a waistband 20. The lower section 10 contains skirt or trousers, both 10. It is well within the purview of this disclosure that a skirt 10 includes any garment that depends from a waistband that is not gathered between the legs. Likewise, it is within the purview of this disclosure trousers 10 include any of pants, shorts, chinos, slacks, flares, cords, breeches, strides, britches, and culottes. It is without saying that also included herein with these groupings, the skort (the combination shorts and skirt). It is noted that the specifics of this disclosure are not limited to uniform bottom garments, rather any garment that has a waistband 20 and fabric 10 depending therefrom.

Figure 5:
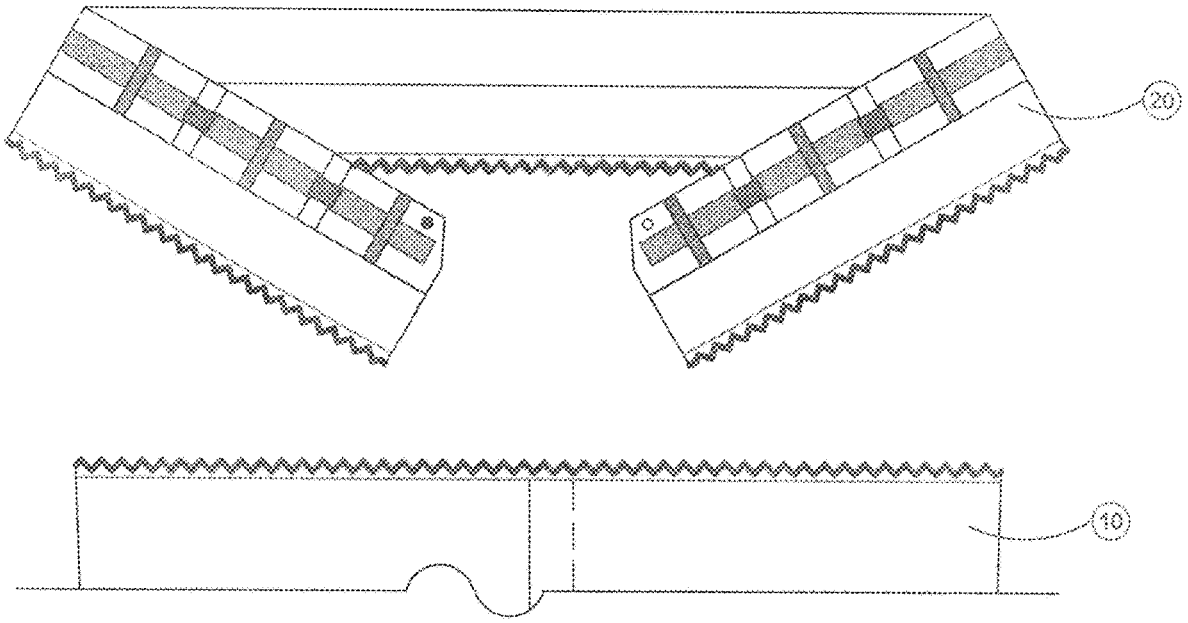
FIG. 5 illustrates the separable waistband separated from the lower section of the preferred aspect of the invention.
Figure 6:
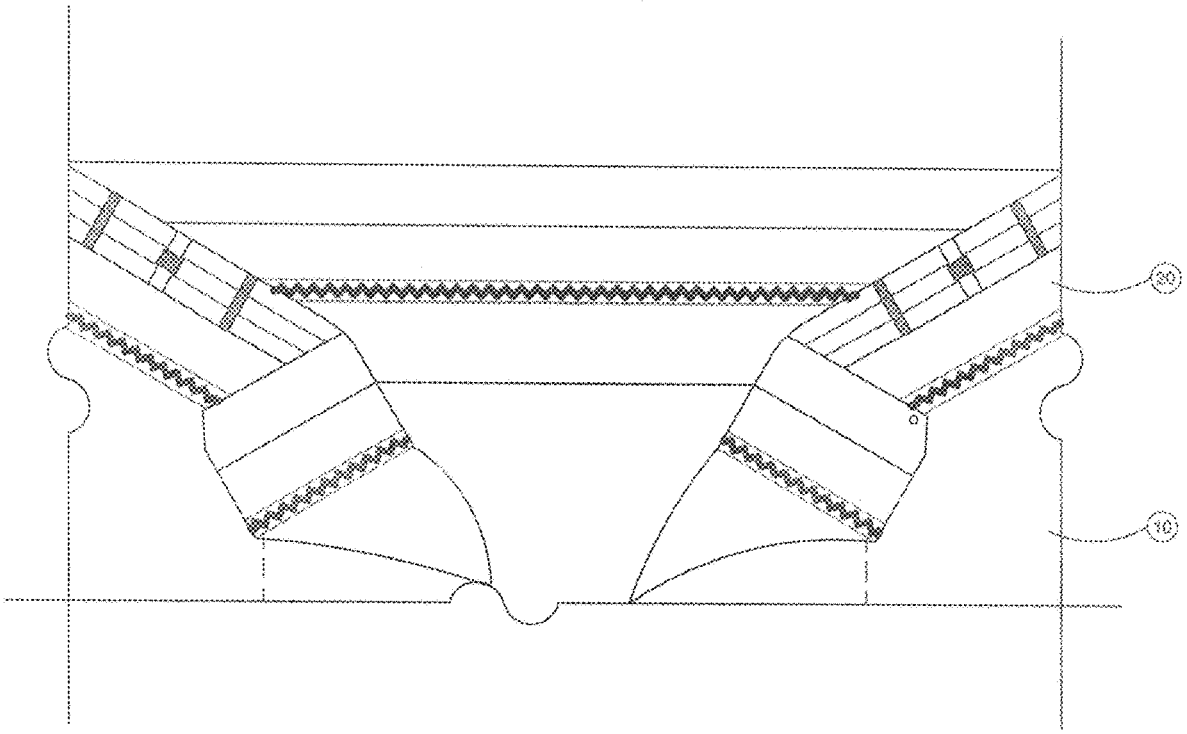
FIG. 6 illustrates the separable waistband connected to the lower section in the preferred aspect of the invention.

Between the upper 20 and lower 10 sections, as seen in FIGS. 2, 5, and 6 of the uniform bottom garment 100, is a device 40A/B for selectively separating the lower section 10 from the upper section 20. The device 40A/B for selectively separating is primarily a zipper configuration, including zipper pulls 42, discussed herein below. It is to be understood that this disclosure is not limited to the zipper configuration 40A/B, but rather includes a plethora of similar devices such as buttons and button holes/loops, hook and loop fasteners, magnetic strip connectors, snaps, or clasps, or the like. For the understanding of the instant disclosure, a zipper configuration is described.

The preferred zipper configuration 40 with a first zipper component 40A attached to the lower edge of waistband 20 and a second zipper component 40B attached to the upper edge of trousers 10. The zipper configuration 40A/B, in accordance with the preferred aspect of the invention, has a pair of semi-circumferential zippers 40 extending from the rear of the trousers to the front. The zipper pair is substantially hidden from view (see FIG. 6) when the upper and lower sections are connected together. Likewise, the zipper configuration includes a single zipper the extends the entire circumference of the uniform bottom garment. Upon demand, each one of the zipper pair is disengaged via zipper pull 42, allowing the lower section 10 of the garment 100 to be removed while maintaining the waistband 20 supporting the utility or tactical belt (not shown) intact. Upon the return of the lower section zipper parts to reengage with the waistband zipper parts, the garment is restored and the professional has maintained accessibility to the tactical belt at all times.

The upper section 20 of the uniform garment has a waistband 20, a length of material forming the waistband that encircles the waist of the professional, and with a connector 14 securing the ends together. The waistband has an interior and exterior formed by two layers of fabric material joined together at the edges. The exterior has a plurality of band members serving as belt loops spaced and permanently attached around the exterior of the waistband.

The exterior has a slit extending substantially the entire length of the waistband. The slit, or aperture allows access to the interior of the waistband.

Figure 4:
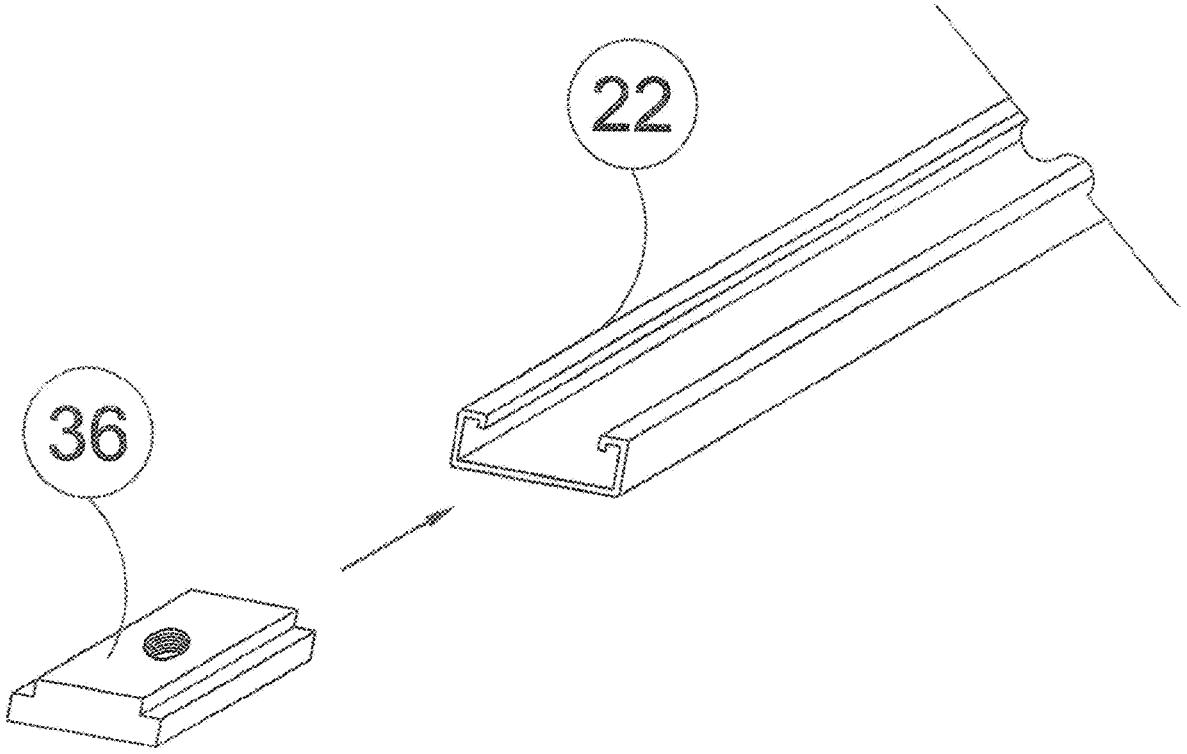
FIG. 4 shows a diagrammatic exploded view of interior of the waistband of the preferred aspect of the invention.

The interior is equipped with a substantially rigid member 22, as seen in FIG. 4 extending around the interior waistband. The substantially rigid member 22 is similar to a track being designed and configured as a substantially C-shaped channel. The substantially rigid member is affixed to the interior of the waistband, the opening of the substantially C-shaped channel being aligned with and accessible via the aperture of the exterior.

Figure 1:
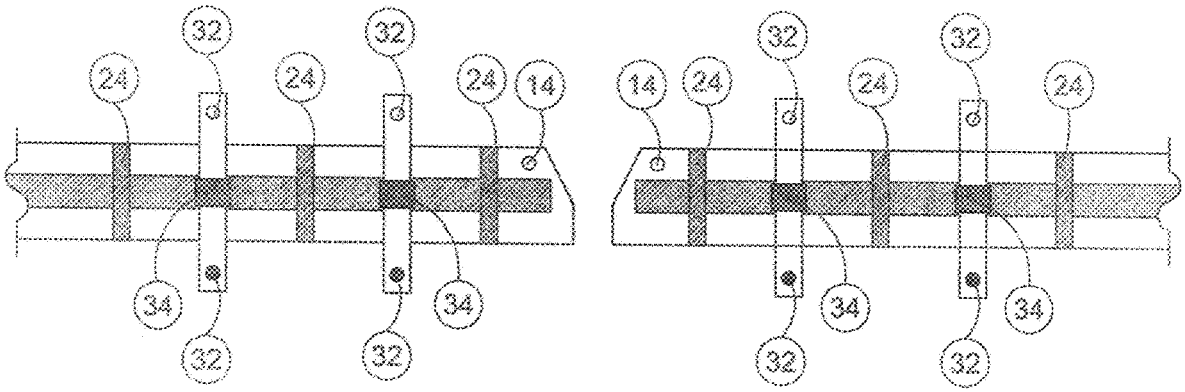
FIG. 1 shows an elevational view of the preferred aspect of the invention.

As seen in FIG. 1, disposed with and cooperating therein are a plurality of anchors 36. The anchors 36 are slidably received into the substantially rigid member 22 (see FIG. 4). The anchors 36 are selectively positioned around the C-shaped channel 22 of the rigid member. Each one of the anchors has flanges for engaging the sides of the channel, thus retaining the anchors securely in the interior of the channel. Albeit the flanges prevent the plurality of anchors 36 from exiting the opening of the C-shaped channel and the aperture, the flanges also are designed and configured to be snapped into the channel 22 via the aperture. The anchors receive a plurality of support members 30 via mechanical coupling, such as threaded bolt, snap fasteners, expandable inserts, and the like. The support members 30 are thus respectively releasably attached to each one of the anchors 36. Each of the support members 30 has a pair of flexible straps extending therefrom, having releasable couplings 32 at the ends thereof. The flexible straps are designed and configured to encircle a utility/tactical belt, to support thereon.

Figure 7:
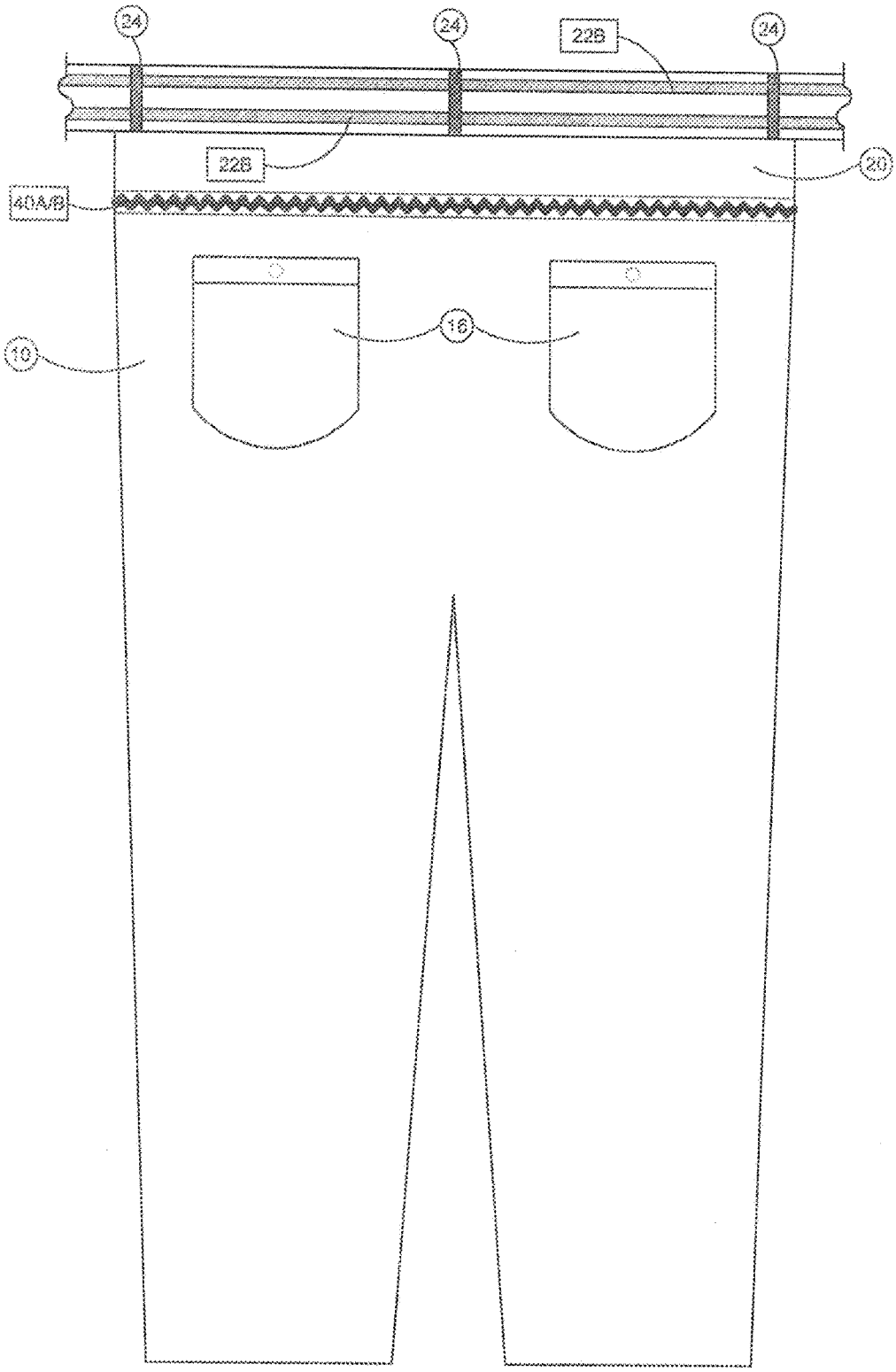
FIG. 7 illustrates an alternate aspect of the invention.

In an alternate configuration, as seen in FIG. 7 the substantially rigid member 22 is replaced by a pair of boning strips 22A and 22B. Boning strips 22A and 22B are attached to the interior of the waistband, in a parallel alignment about the waistband. The boning strips 22A and 22B are secured to the interior of the waistband and forming a receiver for the flanges of the anchors 36. The boning strips 22A and 22B, along with the attachment to the interior of the waistband effectively form a C-shaped channel, having more flexibility than the aforementioned C-shaped channel 22, yet with the same tensile strength for supporting the anchors 36 therein. Boning strips 22A and 22B are attached via stitching, adhesive, or any known bonding technique, as long as the anchors 36 are received therebetween. Boning strips 22A and 22B are fabricated from plastics or metals, as commonly recognized in the art. The boning strips 22A and 22B are preferably disposed within the slit, attached to the interior of the waistband however, boning strips 22A and 22B may be disposed along the exterior of the waistband, for easier access for inserting the anchors 36.

Upon positioning the anchors 36 and support members 30 about the waistband 20; the professional inserts a standard belt through the belt loops 24 of the waistband 20, superimposed to the support members 30, and underlying the belt loops 24. The standard belt is fashioned with any known buckle or latch for snugly yet comfortably seated upon the waist of the professional, in order to maintain the garment, i.e., the uniform garment, in proper disposition.

Figure 8:
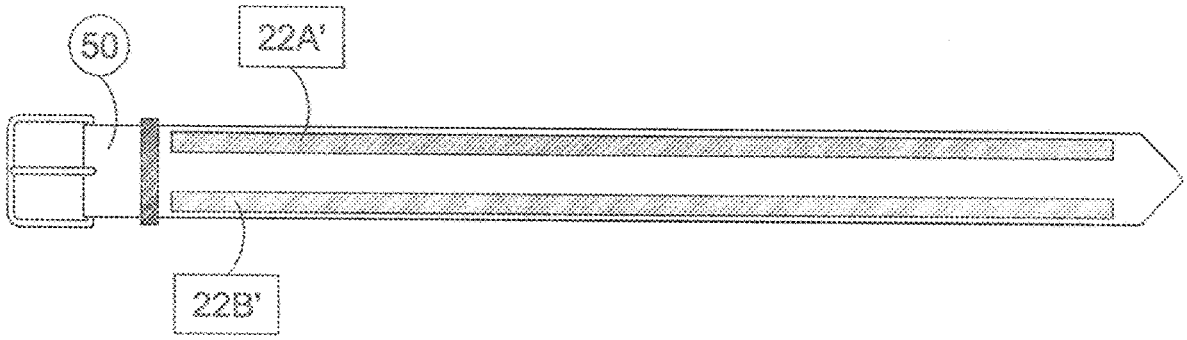
FIG. 8 illustrates another embodiment of the invention.

In FIG. 8, another aspect of the invention, the boning strips 22A and 22B are disposed about the standard belt 50 in order to form the channel along the length of the belt 50. The belt 50 is threaded through the belt loops 24 of the waistband 20, the support anchors 36 are placed within the channel formed by the boning strips 22A and 22B, and are preferentially distributed therearound. The channel 22 (as seen in FIG. 1), formed by the boning strips 22A' and 22B', the flanges of anchors 36 also are designed and configured to be snapped into the channel 22 between boning strips 22A' and 22B'. The anchors receive a plurality of support members 30 via mechanical coupling, such as threaded bolt, snap fasteners, expandable inserts, and the like. The support members 30 are thus respectively releasably attached to each one of the anchors 36. Each of the support members 30 has a pair of flexible straps 34 extending therefrom, having releasable couplings 32 at the ends thereof. The flexible straps 34 are designed and configured to encircle a utility/tactical belt, to support thereon.

The professional is provided with an accessory or a tactical belt. The accessory/tactical belt has a plethora of attachments for the professional to use, and these attachments are easily and quickly accessible when needed while the professional performs their duty or work function. The accessory/tactical belt is secured to the upper member of the garment by the plurality of support members. This securing is accomplished by the ends of the extensions of the support members being coupled together, each encircling the accessory/tactical belt about the waistband. It is well within the purview of this disclosure that the accessory/tactical belt is independently supported on the exterior of the upper portion of the garment by the plurality of support members, which are likewise supported by the plurality of anchors in the C-shaped channel.

The professional has better access to the lower section of the garment for removal, if needed, by selectively disengaging the lower portion of the garment. Such needs are for toilet access, undergarment replacement, and, in the case of a professional on a menstrual cycle, or the like, without having to remove accessory/tactical belt attached to the upper portion of the garment. This is clearly evident when in circumstances of law enforcement or military professional on duty, needing to have such a toilet break, and an incident arises, the professional, though uniquely undressed, is still prepared, and has their weapon or other necessary accoutrements readily accessible because the accessory/tactical belt has not been removed. In previous instances, the accessory/tactical belt would have been removed rendering the professional vulnerable and unready for the incident.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein. The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A garment comprising:

an upper portion containing a waistband;

the waistband having an interior and exterior;

the exterior having a plurality of band members forming belt loops around the exterior of the waistband; and the exterior having an aperture to the interior of the waistband;

the interior having a substantially rigid member extending around the waistband, the rigid member having a substantially C-shaped channel, the opening of the substantially C-shaped channel being accessible through the aperture of the exterior;

a plurality of anchors slidably received into the substantially rigid member, each one of the anchors being selectively positioned around the C-shaped channel of the rigid member;

wherein each one of the anchors have flanges, the flanges prevent the plurality of anchors from exiting the opening of the C-shaped channel and the aperture;

a plurality of support members, each one of the support members respectively releasably attached to each one of the anchors;

an accessory belt secured to the upper member of the garment by the plurality of support members;

wherein the accessory belt is independently supported on the exterior of the upper portion by the plurality of support members and the plurality of anchors in the C-shaped channel;

a lower portion extending from the waist band;

a separable connector between the upper portion and the lower portion;

the separable connector allowing the lower portion to be selectively disengaged from waistband of the upper portion;

wherein the wearer selectively disengages the lower portion of the garment for toilet access without having to remove accessory belt attached to the upper portion of the garment.

2. The garment according to claim 1, wherein the lower portion is a pair of trousers.

3. The garment according to claim 1, wherein the lower portion is a skirt.

4. The garment according to claim 1, wherein the lower portion is a pair of shorts.

5. The garment according to claim 4, wherein the pair of shorts include a skort.

6. A utility belt support system comprising:

a garment having an upper portion and a lower portion;

a releasable fastener between the upper portion and the lower portion;

the upper portion containing at least a waistband portion;

a plurality of belt loops disposed around the waistband portion;

a channel defined about the waistband portion;

a plurality of anchors designed and configured to slidingly engage the channel, each anchor having a pair of extensions for maintaining the anchors in the channel;

wherein the plurality of anchors is selectively distributed about the channel; and a pair of support straps extending from each anchor, each pair of support straps matingly engage forming a loop from each one of the anchors;

wherein each pair of the support straps encircle a utility belt, engaging the holding and maintaining the utility belt in close proximity to and about the waistband portion;

whereby the releasable fastener allows the upper portion of the garment and the lower portion of the garment to be separated such that the utility belt is maintained around the waistband of the upper portion.

7. The utility belt support system according to claim 6, further comprising:

a port defined in the waistband portion, the port extending substantially about the waistband portion;

wherein the channel is disposed in the interior of the waistband portion, the port providing access to the channel, the anchors being selectively placed in the channel and the support straps extending out of the port, thereby securing and supporting the utility belt to the waistband portion.

8. The utility belt support system according to claim 6, further comprising:

a belt for threading through the belt loops on the waistband portion, the belt being designed and configured to have a channel thereon;

wherein the channel is formed by a pair of boning strips parallelly attached to the belt.

9. The utility belt support system of claim 8, wherein the boning strips are parallelly attached to the belt, such that the channel is formed therebetween;

whereby the anchors are selectively and slidably disposed about the belt and retained therein by the flange ends engaging the channel formed by the boning strips; and whereby the support straps are engaged around the utility belt, supporting and maintaining the utility belt about the waistband.

* * * * *